US006842917B1

(12) United States Patent
Genova

(10) Patent No.: US 6,842,917 B1
(45) Date of Patent: Jan. 18, 2005

(54) SPA COVER LIFT

(75) Inventor: Michael C. Genova, Spokane, WA (US)

(73) Assignee: Leisure Concepts, Inc., Spokane, WA (US)

( * ) Notice: Subject to any disclaimer, the term of this patent is extended or adjusted under 35 U.S.C. 154(b) by 0 days.

(21) Appl. No.: 10/681,325

(22) Filed: Oct. 7, 2003

(51) Int. Cl.[7] ..... E04H 4/06

(52) U.S. Cl. ..... 4/498; 4/496; 49/339; 160/210

(58) Field of Search ..... 4/498, 503, 496, 4/580, 581; 49/339; 160/210

(56) References Cited

U.S. PATENT DOCUMENTS 3,895,400 A * 7/1975 Kelcey ..... 4/503 X
5,303,527 A * 4/1994 Perez et al. ..... 4/498 X
5,621,926 A * 4/1997 La Madeleine ..... 4/498
5,974,600 A * 11/1999 Pucci et al. ..... 4/498
6,272,695 B1 * 8/2001 Brandner ..... 4/498
6,393,630 B1 * 5/2002 Tedrick ..... 4/498
6,665,890 B1 * 12/2003 Tedrick ..... 4/498

* cited by examiner

*Primary Examiner*—Gregory L. Huson
*Assistant Examiner*—Kathleen J. Prunner
(74) *Attorney, Agent, or Firm*—Randy A. Gregory; Gregory I.P. Law

(57) ABSTRACT

A spa cover lift and cover construction that easily accommodates use with odd sizes and shapes of spas. The construction uses a column which is positioned at a single location about the periphery of the spa. A foot piece can be included at the bottom of the column which slips under the spa to use the weight of the spa and water to help hold the cover lift and cover securely. The column is preferably adjustable in height. It has pivot arms which extend in recesses formed in the underside of one half of the cover. The pivot arms extend from the column out to the side edges and are looped to form a handle and return that further supports the cover on the lift. The pivot arms may have tail ends that engage a bumper when the cover lift is retracted. Control arms may be pivotally connected between the column and pivot arms to resist erratic movements.

14 Claims, 5 Drawing Sheets

SPA COVER LIFT

TECHNICAL FIELD

The invention relates to covers and cover support apparatus for spas, particularly those capable of use on circular or other non-rectangular or odd shapes.

BACKGROUND OF THE INVENTION

The popularity of spas and hot tubs has increased over the last years to a substantial degree. To save energy a spa is best covered with an insulating cover that retains heat in the water.

A number of different spa cover lift constructions have been designed. Despite the number of designs already available, it is still desirable to have an improved cover which has both aesthetically pleasing appearance and is easy to operate. It is also desirable to have an improved is spa cover lift which requires reduced amounts of materials and is economical to produce.

A problem frequently encountered with spa cover lifts is that they typically require a considerable amount of space along the side to which the cover is removed. This increases the general space requirement of the spa.

Another area of particular significance to this invention is the need for an improved spa cover lift and cover which are adapted to accommodate circular and other non-rectangular spas. Round and other odd-shaped covers, such as octagons, ellipses, hexagons and other potentially attractive spa shapes have been a greater problem to provide a cover lift and combined cover and lift assembly which does not detract from the appearance of the spa installation.

Additionally, the space about the spa is typically restricted when a cover lift is used because they have two spaced mounts. This does not accommodate circular and odd shapes of covers and spas and enable an attractive and clean appearance. Good access from all sides of the spa is also particularly difficult with odd-shaped spas.

The current invention seeks to solve one or more of these concerns or problems in an improved combination not heretofore known in the art of spa covers and associated lift mechanisms.

BRIEF DESCRIPTION OF THE DRAWINGS

Preferred embodiments of the invention are described below with is reference to the following accompanying drawings.

DETAILED DESCRIPTION OF THE PREFERRED EMBODIMENTS

Introductory Note

The readers of this document should understand that the embodiments described herein may rely on terminology used in any section of this document and other terms readily apparent from the drawings and language common therefor. This document is premised upon using one or more terms with one embodiment that will in general apply to other embodiments for similar structures, functions, features and aspects of the invention. Wording used in the claims is also descriptive of the invention. Terminology used with one, some or all embodiments may be used for describing and defining the technology and exclusive rights associated herewith.

Spa, Cover and Cover Lift Generally

Figure 1:
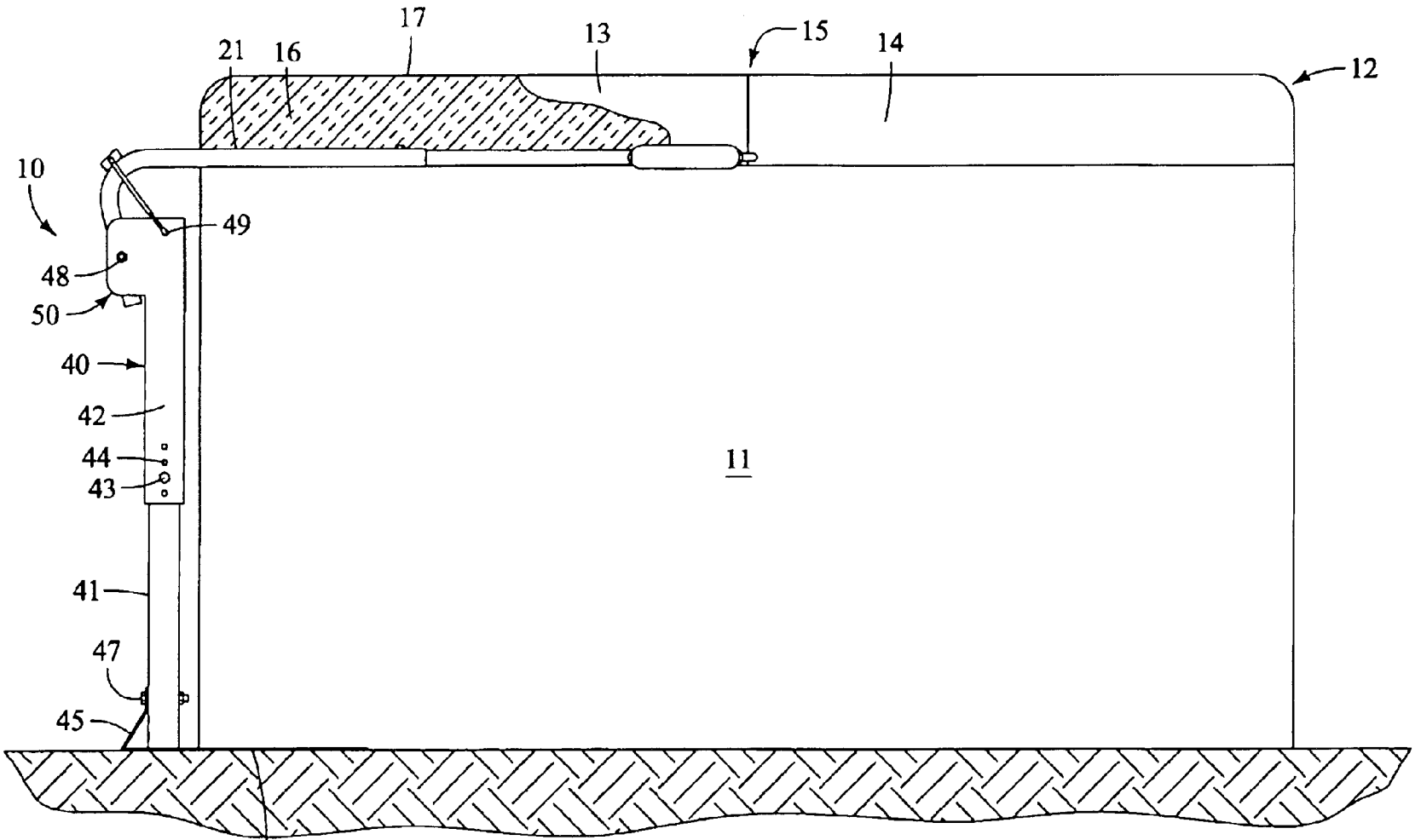
FIG. 1 is a side elevation view of a spa fitted with a cover and spa cover lift made in accordance with a preferred form of the invention as positioned in a deployed position.

FIG. 1 is a side view showing a preferred combined spa, spa is cover and spa cover lift assembly 10 in accordance with one preferred form of the invention.

The assembly has a spa 11 which can be of various shapes and sizes. Of particular importance to this invention are spas which have non-rectangular shape, such as circular, elliptical, octagonal, hexagonal, and other odd shapes now available or hereafter developed. With such non-rectangular spa shapes the use of prior art covers is less attractive and hampers access to the spa about substantial portions of the periphery of the spa.

Spa Cover

Assembly 10 also includes a spa cover 12 having a first part 13 and a second part 14. Typically the first and second parts are halves of the cover. The halves or other parts are connected along a folding joint which is frequently a flexible film, fabric or other material which can flex. The folding joint 15 is best viewed in FIG. 2. In most currently available spa covers the joint is formed using a flexible material which is sewn or otherwise constructed using the material layer 17 which encases the insulation 16 (FIG. 1) contained internally within the spa cover.

As FIG. 1 shows, the spa cover 12 may be provided with pivot arm recesses 21 which allow the pivot arm assembly described below to be positioned. This is preferably done so that the bottom surfaces of the pivot arm assembly are approximately even with the lower surface of the cover portion beneath which the pivot arm assembly is positioned.

Column Assembly

Figure 4:
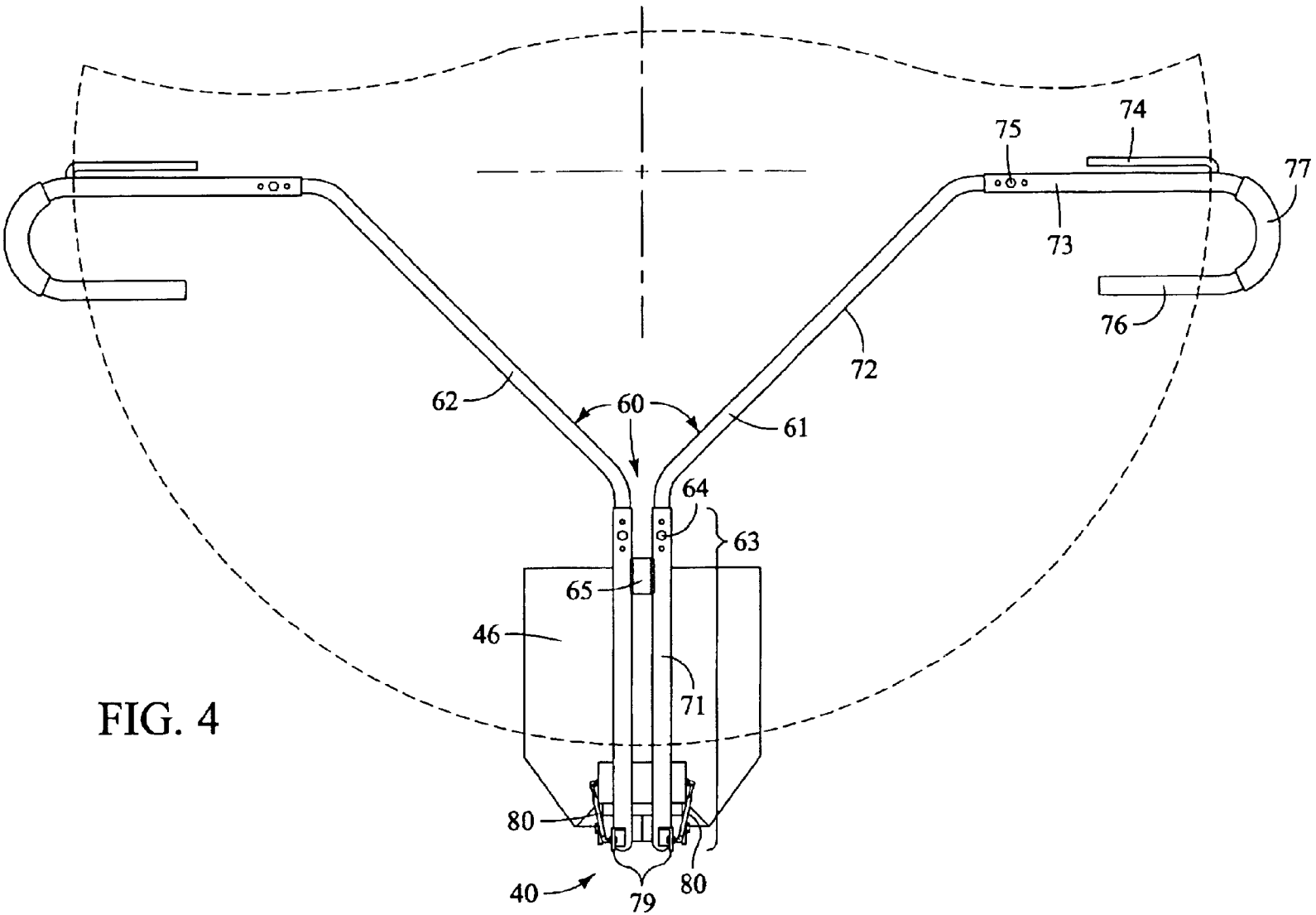
FIG. 4 is a top view of the spa cover lift shown in FIG. 1 with the spa cover shown in dashed lines to better present the cover lift features.

The invention includes a column assembly which is preferably constructed to be at approximately a single location along the periphery of the spa and spa cover. This is best illustrated in FIG. 4 which shows the column assembly 40 from above.

Referring to FIG. 1, the preferred column assembly 40 includes a first or lower part 41 and a second or upper part 42. As shown, parts 41 and 42 telescope, such as with part 41 telescoping and being received into part 42. This allows the height of the column head 50 to be adjusted using a series of holes 44 through which are extended one or more column height fastening bolts 43.

Figure 2:
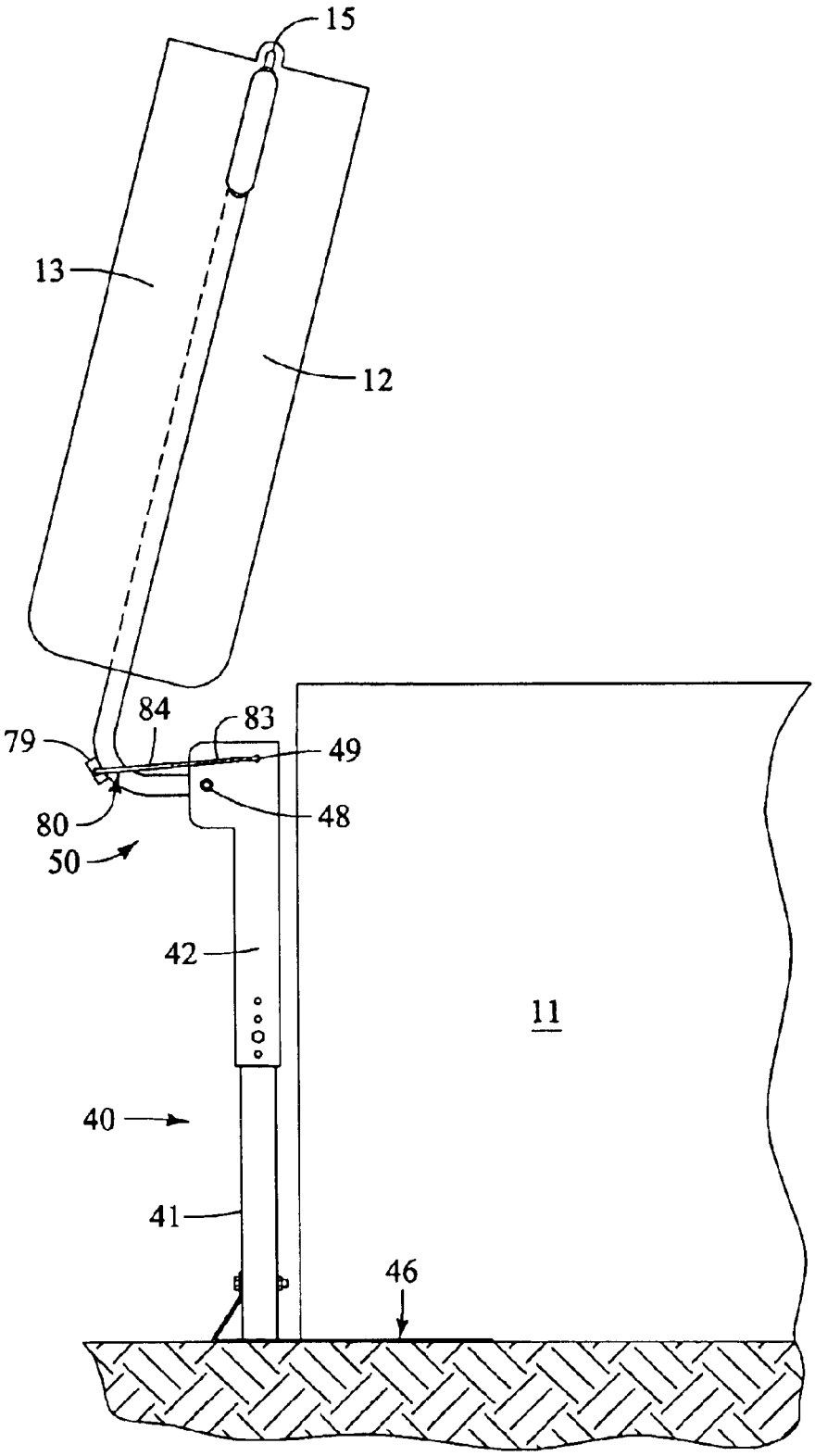
FIG. 2 is a side elevation view of the spa, cover lift and cover shown in FIG. 1 moved into a retracted position converted from the deployed position of FIG. 1.
Figure 5:
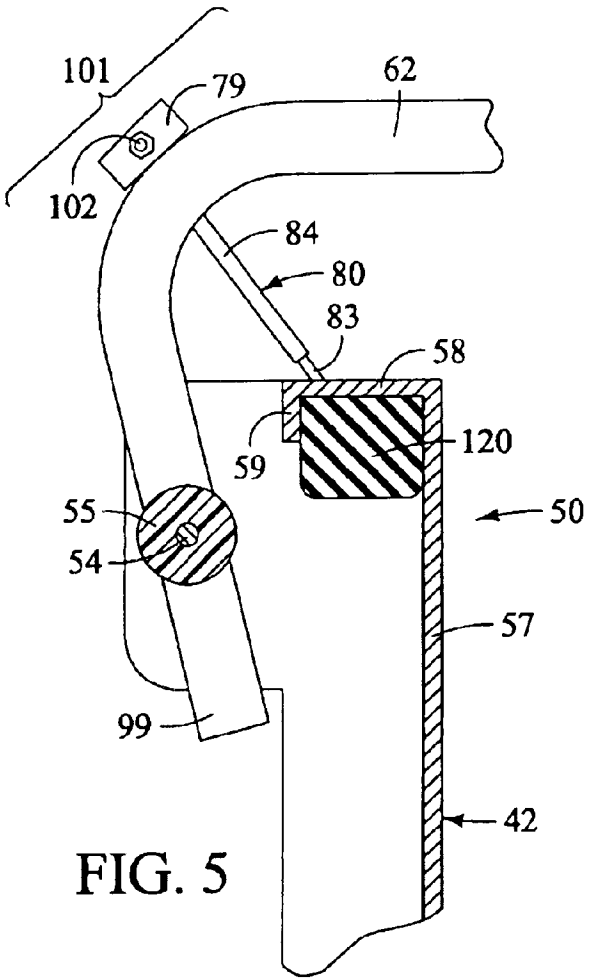
FIG. 5 is an enlarged, detailed, cross-sectional view of the pivot and stop assembly taken from the same view angle as the side elevational view of FIG. 1 with the cover lift in the deployed position.

The column assembly 40 further advantageously includes a pair of opposing side plates having pivot apertures 48 therein through which extends a pivot bolt or other shaft 54 (FIG. 5). The pivot shaft extends through a pivot mount section of a pivoting arm assembly generally referred to by the reference numeral 60 (FIG. 4). FIG. 2 shows the pivot arm assembly moved to an upstanding retracted position.

Figure 3:
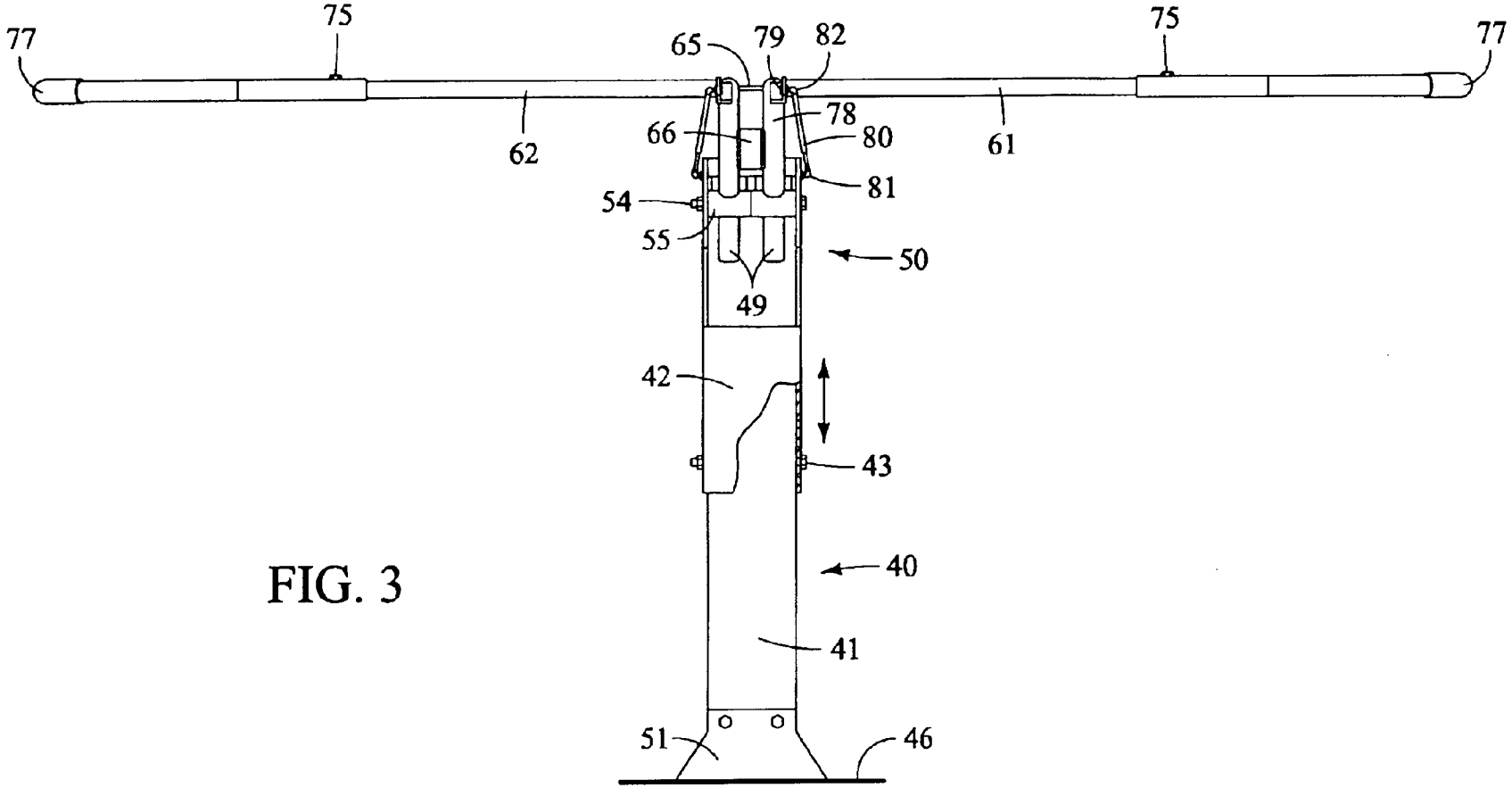
FIG. 3 is a front elevational view of the spa cover lift of FIG. 1 shown in isolation from the spa and spa cover.

FIG. 3 shows that the upper or second part 42 of the column assembly is preferably constructed with a lower tubular portion and an upper or head portion 50. The head portion has an open back side which allows the pivot arm assembly to operate through the intended range of motion. The head 50 may advantageously include extension wings 53 which position the pivot axis of shaft 54 rearwardly relative to the back of the spa and spa cover.

The column assembly also preferably includes a front head wall 57 which is attached to the side walls of the head 50. The front head wall is preferably integrally formed or connected to a top piece 58 of the head.

A head flange 59 is connected to the outer or distal edge of the top piece 58 and extends downwardly. This construction is used to capture a bumper 120 which is preferably made from an elastomeric material such as rubber, neoprene or other suitable materials which provide elastic reaction when engaged by the tail ends 99 of the pivot arm assembly 60 when moved to the retracted position.

The column assembly further advantageously is provided with a foot piece 46. Foot piece 46 may be connected to or integral with the lower part 41 of the column. As shown, the foot piece 46 is fastened to the lower column part using a bracket 45 and fastener 47 which extends through the lower column part 41 and bracket 45. The foot piece 46 is integral with or connected to the bracket 45.

The foot piece 46 is preferably flat and adapted to slide under the spa 11. Thus the spa with water acts as a heavy counterweight which stabilizes and retains the column assembly in position relative to the spa without using heavy mounting bolts or other means involving fastening the foot piece to the supporting structure, such as a slab of concrete or other suitable material.

Pivoting Arm Assembly

The pivoting arm assembly 60 is used to support the spa cover 12 as the cover is moved over the range of positions between the deployed position of FIG. 1 and the retracted position of FIG. 2. The pivoting arm assembly also advantageously helps to support the flexible hinge or folding joint 15. Furthermore, the preferred design provides convenient handle grips 77 which are used by humans to operate the lift and cover from either side of the spa (see FIG. 4).

In the construction shown, the pivot arm assembly 60 includes a first pivot arm 61 and a second pivot arm 62. The first and second pivot arms have proximal sections 63 which are connected at the pivot connection is at shaft 54. In the illustrated construction the proximal sections 63 have tie bars 65 (FIG. 4) and 66 (FIG. 3) which tie the proximal portions of the pivot arms together. This causes the arms to pivot together and allows operation from either side of the spa. The tie bars 65 and 66 are preferably welded or otherwise securely fixed to the proximal portions 63 of the pivot arms 61 and 62.

Figure 6:
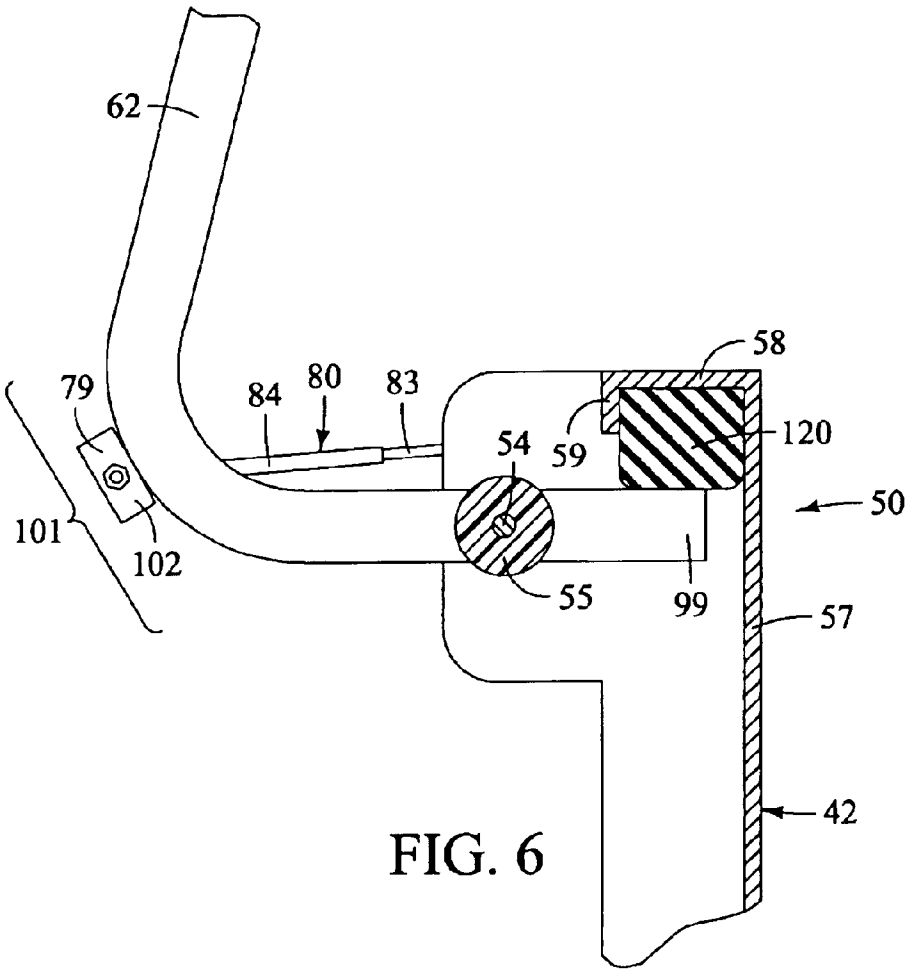
FIG. 6 is an enlarged, detailed, cross-sectional view of the pivot and stop assembly taken from the same view angle as the side elevational view of FIG. 2 with the cover lift in the retracted position.

FIGS. 5 and 6 show that the pivot arm assembly 60 is mounted in a preferred way to accomplish several advantageous features and capabilities. As shown, the shaft 54 extends through the pivot mount portions of the pivot arms captured within elastomeric bushings 55. Bushings 55 are positioned over the tail ends 99 before the shaft 54 is extended therethrough. This pivot mounting arrangement provides added resiliency to help accommodate a user that may accidently or carelessly throw the cover and lift assembly rearward into the retracted position.

FIG. 4 shows that the pivot arm assembly 60 is advantageously constructed using proximal portion 63 by joining individual proximal sections 71 of the first and second pivot arms 61 and 62. The proximal sections preferably extend inwardly of the spa and spa cover from the column assembly.

The distal ends of proximal sections 71 are advantageously provided with detachable couplings 64. The detachable couplings 64 may be snap lock couplings that do not require tools to assemble or disassemble. Other alternative couplings may also be used.

The pivot arms 61 and 62 also have central sections 72 that are connected at couplings 64. The central sections preferably extend at an oblique angle relative to the proximal sections so they are directed toward the outer sides of the spa cover roughly towards the folding joint 15. The proximal ends of the central section are bent, such as at about 30–60 degrees, more preferably about 45 degrees, from the centerline defined by the proximal sections 63. This directs the main portions of these central sections obliquely at about 135 degrees when measured about the complementary side of the angular connection and relationship.

The distal ends of the central sections are bent a complementary amount to cause the extreme distal ends of the central pivot arm sections 72 to assume an orientation which is parallel to the fold joint of the spa cover. The end may also be provided with a detachable coupling 75 similar to coupling 64 or suitable alternatives thereof.

The pivot arms 61 and 62 further preferably include third pieces 73 which are detachably or otherwise connected by coupling 75 to central pieces 72. The third pieces each have a support portion which is parallel to the fold joint 15 and is positioned under the fold joint when the cover is installed upon the cover lift. FIG. 4 shows a preferred retainer bar 74 which is connected to clip over the fold joint or portions of the fold joint to better retain the cover and cover lift together during routine use. As shown, the retainer bar 74 is a cantilevered piece which is connected to pieces 73 and extends inward parallel to the fold joint line.

The preferred construction of third pieces 73 also includes handle portions 77. Handle portions 77 may be semicircular as shown or another suitable shape. The semicircular shape illustrated allows the third pieces 73 to also have a return extension portion 76 which comes back toward and under the cover to help distribute forces applied to the handle portions by human operators. Handle portions 77 may also be provided with grip covers which make use more pleasant.

Pivoting Assembly Stops and Control Arms

The pivot or pivoting arm assembly 60 is adapted for limited pivotal action or movement about the pivot shaft 48. As shown, this is preferably done using a bumper 120 which is engaged by the tail ends 99 of the pivot arm assembly when pivoted into the retracted position of FIG. 6. The tail ends pivot against the bumpers 120 and thus take a reaction force to maintain the cover and cover lift in the retracted upstanding position. The tail ends rotate substantially within the column head 50.

FIG. 5 shows the pivot arms include a bend section 101. Attached at the bend section or other suitable location is a control arm or control arms 80. Control arms 80 are preferably provided at each side, but other configurations are possible.

As shown, control arms 80 are pivotally connected to a control arm mounting bracket 79. The opposite ends of the control arms are pivotally connected to the column head at pivot 49 (FIG. 1). The control arms are preferably struts that are linearly extendible and contractible. As shown, the control arms are mechanical dampers (shock absorbers) that prevent rapid or erratic movements of the pivot arm assembly. The struts may also have internal springs to help bias forces developed by the weight of the swinging assembly formed by the pivot arm assembly and cover. The structures of the struts may further alternatively act as additional mechanical stops to assist in distributing forces associated with the cover and cover lift being in the retracted position.

Methods and Use

The invention also includes methods and uses of the components described hereinabove. In one aspect the methods and uses of the invention involve having a spa cover lift that has a singular column structure with attached foot piece that can be slide under and retained by the overlying weight of the spa with which they are used. This provides methods that involve installing the cover lifts and covers by elevating temporarily the spa 11 and sliding the column into proximity to the desired pivoting side of the spa cover lift and then installing the column and foot piece in position adjacent to the spa and with the foot piece thereunder. The spa is then lowered so that the substantial weight of the spa and contained water bear upon the foot piece to retain it and the attached column and remaining portions of the cover and cover lift are held securely without the added cost and difficulty of installing fasteners.

In another aspect the methods and uses of the invention involve installing a cover upon a cover lift having proximal sections that extend inwardly under a portion of the spa cover to allow support thereon. The pivot arm assemblies having the proximal section also extend outwardly toward the sides of the spa and inwardly toward the fold line of the cover fold joint.

In another aspect the invention includes having pivot arm assemblies that have parallel portions that extend along the folding joint of the spa cover and are positioned under the spa cover to allow the spa cover to rest and be supported thereon. This effects a distributing of forces over the parallel portions and allows the tendency of the cover to swing to be accommodated without destructive effects on the cover and cover lift.

In a further aspect the methods include retaining cover upon the cover lift using the cover retainers 74 by sliding the cover with the cover folding joint within the capture space defined between the cover retainers and the pivot arm sections 73.

In a further aspect the invention includes recessing the pivot arm assemblies into the underside of the cover portion under which the pivot arm assemblies are positioned. This helps to stabilize the cover upon the cover lift pivot arm assemblies and provides an integrated structural relationship between the cover and lift pivot arms. This increases stability and rigidity without increasing weight and requiring additional materials.

In another aspect the cover and cover lift are operated by grasping extending portions of the pivot arms, such as handle portions 77 and lifting upwardly. The lifting action leads to distributing weight between the return segment 76 and the parallel section of part 73. This substantially reduces the sharpness or concentration of forces upon the cover and helps to reduce wear and tear.

In a further aspect the operator of the cover lift acts by applying upward forces upon the pivot arm or arms and thus lifting the cover and cover lift arms upwardly and pivoting the pivot arms. The arms are pivoted upwardly and rearwardly.

The methods further advantageously include dampening the mechanical action of the pivot arm assembly or assemblies by the use of struts 80 or other control arms which can resist by damping or biasing springs or a combination thereof the erratic forces that may sometimes be applied by human operators. Further the control arms may provide a stopping action that resists over-rotation of the pivot arm assemblies to an excessive backward position.

In another aspect the methods include pivoting the pivoting arms into a retracted position and engaging portions of the pivoting arms against a bumper or bumpers thus stopping the pivoting. The bumpers may further act by stopping and maintaining the pivot arms in a desired retracted position.

Still further aspects of the methods include closing the spa cover upon the spa using the spa cover lift. This may be done by grasping the pivot arm assembly, such as by grasping the handle extension and applying force which is directed forwardly toward the spa and downwardly toward the top surface of the spa. The portion of the spa cover not in contact with the pivot arm assembly is swung outwardly to position it over the front of the spa and the cover lift is depressed until the cover is flattened onto the upper surfaces of the spa to form a snug compliance which resists heat loss.

Further Aspects and Features

The above description has set out various features and aspects of the invention and the preferred embodiments thereof. Such aspects and features may further be defined according to the following listing which may individually or in various combinations help to define the invention.

Interpretation Note

The invention has been described in language directed to the current embodiments shown and described with regard to various structural and methodological features. The scope of protection as defined by the claims is not intended to be necessarily limited to the specific features shown and described because other forms and equivalents for implementing the invention can be made and in some cases this is done simply to evade the intended purpose of this document and any exclusive rights associated therewith.

I claim:

1. An apparatus forming a spa cover lift, comprising:

a column assembly having at least one column member which engages a supporting surface and extends upwardly at an approximately single position along the periphery of a spa;

at least one pivoting arm assembly which is pivotally connected to said column assembly along a main pivot axis for pivot movement between a deployed position and a retracted position; said at least one pivoting arm assembly having a first extension which extends to a first side and a second extension which extends to a second side which is in opposing relationship to said first side;

at least one extensible strut pivotally connected to said column assembly and pivotally connected to said at least one pivoting arm assembly, said at least one extensible strut being mounted such that the at least one extensible strut is extensible between a contracted condition and an elongated condition by pivotal action of said at least one pivoting arm assembly relative to said column assembly;

at least one bumper for engagement by said at least one pivoting arm assembly when the at least one pivoting arm assembly is in the retracted position.

2. An apparatus according to claim 1 wherein the at least one extensible strut is constructed to function as a limiting stop when the at least one pivoting arm assembly is pivoted to the retracted position.

3. An apparatus according to claim 1 wherein the at least one extensible strut is constructed so as to function as a mechanical damper to slow pivotal action of the at least one pivoting arm assembly.

4. An apparatus according to claim 1 and further comprising grips formed upon the distal ends of the first and second extensions of said at least one pivoting arm assembly.

5. An apparatus according to claim 1 and further comprising at least one foot piece which is connected to the column assembly and is adapted to be inserted under a spa to assist in holding the cover lift in position.

6. An apparatus according to claim 1 wherein the first and second extensions of the at least one pivoting arm assembly have at least one detachable connector for connecting portions of the first and second extensions into the at least one pivoting arm assembly.

7. An apparatus according to claim 1 wherein the at least one pivoting arm assembly is formed using first and second arm assemblies.

8. An apparatus according to claim 1 wherein the at least one pivoting arm assembly is formed using first and second arm assemblies which are connected together to pivot in connected relationship.

9. An apparatus forming a combined spa cover and cover lift assembly, comprising:

a spa cover having two portions which are joined by a folding joint;

a column assembly having at least one column member which engages a supporting surface and extends upwardly at an approximately single position along the periphery of a spa;

at least one pivoting arm assembly which is pivotally connected to said column assembly along a main pivot axis for pivot movement between a deployed position and a retracted position said at least one pivoting arm assembly having:

a main arm which extends inwardly from the column assembly toward the folding joint of the spa cover;

a first extension at least portions of which extend along the folding joint of the spa cover and extend beyond a first side of the spa cover;

a second extension at least portions of which extend along the folding joint of the spa cover and extend beyond a second side of the spa cover;

and wherein the pivoting arm assembly extends beneath at least one of said two portions of the spa cover.

10. An apparatus according to claim 9 and further comprising at least one extensible strut pivotally connected to said column assembly and pivotally connected to said at least one pivoting arm assembly, said at least one extensible strut being mounted such that the at least one extensible strut is extensible between a contracted condition and an elongated condition by pivotal action of said at least one pivoting arm assembly relative to said column assembly.

11. An apparatus according to claim 10 wherein the at least one extensible strut is constructed to function as a limiting stop when the at least one pivoting arm assembly is pivoted to the retracted position.

12. An apparatus according to claim 10 wherein the at least one extensible strut is constructed so as to function as a mechanical damper to slow pivotal action of the at least one pivoting arm assembly.

13. An apparatus according to claim 9 and further comprising at least one bumper for engagement by said at least one pivoting arm assembly when the at least one pivoting arm assembly is in the retracted position.

14. An apparatus according to claim 9 and further comprising:

at least one bumper for engagement by said at least one pivoting arm assembly when the at least one pivoting arm assembly is in the retracted position;

at least one extensible strut pivotally connected to said column assembly and pivotally connected to said at least one pivoting arm assembly, said at least one extensible strut being mounted such that the at least one extensible strut is extensible between a contracted condition and an elongated condition by pivotal action of said at least one pivoting arm assembly relative to said column assembly.

* * * * *